US012110794B2

(12) United States Patent
Liu et al.

(10) Patent No.: US 12,110,794 B2
(45) Date of Patent: Oct. 8, 2024

(54) TWO-STAGE REVERSE-TORQUE BENT SCREW ORIENTATION TOOL

(71) Applicant: Chengdu University of Technology, Chengdu (CN)

(72) Inventors: Qingyou Liu, Chengdu (CN); Jianguo Zhao, Chengdu (CN); Guorong Wang, Chengdu (CN); Haiyan Zhu, Chengdu (CN); Xuecheng Dong, Chengdu (CN); Xingming Wang, Chengdu (CN); Xu Luo, Chengdu (CN); Yingju Pei, Chengdu (CN); Xianwei Dai, Chengdu (CN)

(73) Assignee: Chengdu University of Technology, Chengdu (CN)

( * ) Notice: Subject to any disclaimer, the term of this patent is extended or adjusted under 35 U.S.C. 154(b) by 0 days.

(21) Appl. No.: 18/463,876

(22) Filed: Sep. 8, 2023

(65) Prior Publication Data

US 2024/0093554 A1 Mar. 21, 2024

(30) Foreign Application Priority Data

Sep. 20, 2022 (CN) ..... 202211142368.2

(51) Int. Cl.
*E21B 7/06* (2006.01)
*E21B 17/042* (2006.01)
(Continued)

(52) U.S. Cl.
CPC ..... *E21B 7/067* (2013.01); *E21B 17/042* (2013.01); *E21B 31/00* (2013.01); *E21B 34/066* (2013.01); *E21B 47/06* (2013.01); *E21B 47/13* (2020.05)

(58) Field of Classification Search
CPC ..... E21B 31/00; E21B 17/042; E21B 7/067; E21B 47/13; E21B 34/066; E21B 47/06
See application file for complete search history.

(56) References Cited

U.S. PATENT DOCUMENTS 3,586,116 A * 6/1971 Tiraspolsky ..... E21B 7/067 175/256
5,163,521 A * 11/1992 Pustanyk ..... E21B 47/26 175/45

(Continued)

FOREIGN PATENT DOCUMENTS

CN 2651413 Y 10/2004
CN 105525875 A 4/2016

(Continued)

*Primary Examiner* — Shane Bomar

(57) ABSTRACT

Provided is a two-stage reverse-torque bent screw orientation tool. An existing bent screw orientation technology has the technical problems of large friction resistance, difficult control of a borehole track, a low drilling speed and the like, and restricts economic, safe and long-acting development of oil and gas. In order to solve the above problems, the two-stage reverse-torque bent screw orientation tool is invented and composed of a first-stage clutch mechanism and a second-stage clutch mechanism, and the first-stage clutch mechanism and the second-stage clutch mechanism are both composed of a battery, a battery compartment, a pressure sensor, an electromagnetic valve, a body, a plug, a piston, an outer tooth cylinder, an inner tooth cylinder, a transmission cylinder, a connecting cylinder, a bearing, a limiting cylinder, a lower joint, a thrust bearing, a battery compartment, a circuit board, a cover plate and the like.

10 Claims, 7 Drawing Sheets

(51) Int. Cl.

| | |
|---|---|
| ***E21B 31/00*** | (2006.01) |
| ***E21B 34/06*** | (2006.01) |
| ***E21B 47/06*** | (2012.01) |
| ***E21B 47/13*** | (2012.01) |

(56) References Cited

U.S. PATENT DOCUMENTS

| | | | | |
|---|---|---|---|---|
| 5,410,303 | A * | 4/1995 | Comeau | E21B 47/022 340/856.1 |
| 5,448,227 | A * | 9/1995 | Orban | E21B 47/022 340/855.8 |
| 5,458,208 | A | 10/1995 | Clarke | |
| 6,109,370 | A * | 8/2000 | Gray | E21B 47/022 175/215 |
| 9,109,402 | B1 | 8/2015 | Lasater et al. | |
| 9,347,269 | B2 * | 5/2016 | Marchand | E21B 17/04 |
| 11,834,928 | B1 * | 12/2023 | Tian | E21B 4/003 |
| 2015/0136394 | A1 * | 5/2015 | Turley | E21B 23/00 166/382 |
| 2022/0316312 | A1 * | 10/2022 | Zheng | E21B 44/04 |
| 2024/0093589 | A1 * | 3/2024 | Zhao | E21B 47/13 |

FOREIGN PATENT DOCUMENTS

| | | | |
|---|---|---|---|
| CN | 106837173 | A | 6/2017 |
| CN | 110145231 | A | 8/2019 |

* cited by examiner

TWO-STAGE REVERSE-TORQUE BENT SCREW ORIENTATION TOOL

CROSS REFERENCE TO RELATED APPLICATIONS

This application claims foreign priority of Chinese Patent Application No. 202211142368.2, filed on Sep. 20, 2022 in the China National Intellectual Property Administration, the disclosures of all of which are hereby incorporated by reference.

TECHNICAL FIELD

The present invention relates to the field of oil and gas drilling engineering, and particularly to a two-stage reverse-torque bent screw orientation tool.

BACKGROUND OF THE PRESENT INVENTION

Horizontal well technology is a main technology to develop deep and unconventional oil and gas resources, horizontal well drilling needs borehole track guidance control, and at present, horizontal well guided drilling comprises rotary guidance and bent screw sliding guidance.

1) An existing rotary guidance technology is expensive: a daily cost is 150,000 to 200,000 Yuan calculated according to an average single well guidance period of 45 days, and only a rotary guidance service cost reaches 6.75 Million Yuan to 9 Million Yuan, accounting for 10% to 20% of total drilling costs.
2) A jamming risk of a buried drill tool is high: an outer diameter of a rotary guidance tool is large, and at present, a borehole diameter of most producing wells is 215.9 mm, a maximum diameter of rotary guidance reaches 210 mm, and a gap is less than 6 mm, so that cuttings are very easy to jam the buried drill tool.

Based on the above factors, the horizontal well guidance in China is still dominated by the bent screw sliding guidance. For example, in 2020, a proportion of the bent screw sliding guidance in Sichuan and Chongqing shale gas exceeded 50%, and a proportion of the bent screw sliding guidance in Changqing dense oil and gas even reached 93%. In the process of the bent screw sliding guidance, a drill string does not rotate, and large friction resistance of the drill string is very easy to cause a "backing pressure", leading to ineffective transmission of a bit pressure, and a rate of penetration is usually only 1/10 to 1/5 of that of rotary drilling. The "backing pressure" makes a tool face difficult to adjust and control, and drilling efficiency is reduced by more than 30%.

The rotation of the drill string is one of the most effective means to solve the "backing pressure". For example, a drill string torsional pendulum system based on the reciprocating rotation of the drill string can be accelerated by more than 30%, but the system cannot be applied to a deep well, and the acceleration is limited when a well depth is more than 3000 m. A twin-screw clutch was developed by HyroClutch in Canada. In this tool, one screw provides a rock-breaking torque for a drill bit, and the other screw resists a reverse torque transmitted from the drill bit to a drill rod. However, a pressure consumption of the tool is 5 MPa to 10 MPa higher than that of a conventional drill tool, which cannot meet requirements of field working conditions, and a tool face of the tool cannot be precisely controlled, so that the tool has not been seen in an engineering application experiment. Chuanqing Drilling Company, Chengdu University of Technology (the project team) and the like in China carried out technical researches on an isolated drill string rotation technology, which realized "engagement" and "disengagement" functions of the drill string. However, there are still the problems of uncontrollable tool face and excessively long lower static drill tool (more than 700 meters), and three technical bottlenecks of difficult borehole track control, low drilling speed and net drilling efficiency, and high drill tool jamming risk in the bent screw sliding guidance.

Patents CN201910386427.2, U.S. Pat. No. 9,109,402B1 and the like invent a twin-screw orientation structure, wherein one screw is used for rock breaking, and the other screw is used for resisting a reverse torque. The twin-screw structure in this solution has large energy consumption and pressure consumption, and a performance of a ground mud pump is limited, so that the twin-screw structure has not been applied. Moreover, the twin-screw structure belongs to pure mechanical orientation, so that it is very difficult to control the tool face. Patents CN201710028105.1, U.S. Pat. No. 5,458,208, CN 2651413Y, CN105525875A and the like invent a clutch mechanism, but a rotation angle of these clutch mechanisms executing clutching operation once is large and exceeds 30°, so that a tool face control precision is low. Due to the limitation of mechanical property, clutching time is long, so that a drill rod rotating speed is small, thus being difficult to meet a high rotating speed requirement.

Therefore, it is urgent to invent an orientation system with tool face angle controllability and high control precision, a high rotating speed, a low drill tool jamming risk and a low cost, which can effectively solve the technical bottlenecks of 'backing pressure' of the drill string, difficult borehole track control and the like, and significantly reduce the difficulty of orientation operation.

SUMMARY OF PRESENT INVENTION

In order to overcome the defects in the prior art, a two-stage reverse-torque bent screw orientation tool is invented, which is composed of a first-stage clutch mechanism (100) and a second-stage clutch mechanism (200), wherein the first-stage clutch mechanism (100) and the second-stage clutch mechanism (200) are both composed of a fixing screw A (1), a battery plug (2), a cover plate (3), a circuit board (4), a battery (5), a battery compartment (6), a pressure sensor (7), an electromagnetic valve (8), a body (14), a plug (15), a fixing screw B (17), a piston (18), an outer tooth cylinder (20), an inner tooth cylinder (21), a transmission cylinder (22), a bearing A (23), a limiting cylinder (24), a bearing B (25), a lower joint (26), a connecting cylinder (27) and a diamond compact (28);

the lower joint (26) of the first-stage clutch mechanism (100) is in threaded connection with the battery compartment (6) of the second-stage clutch mechanism (200);

the battery compartment (6) is in threaded connection with the body (14), the body (14) is in threaded connection with an upper end of the inner tooth cylinder (21), and a lower end of the inner tooth cylinder (21) is in threaded connection with the limiting cylinder (24);

the plug (15) is in threaded connection with an upper end of the outer tooth cylinder (20), a spline A (2002) at a lower end of the outer tooth cylinder (20) is in splined connection with a spline B (2201) at an upper end of the transmission cylinder (22), a lower end of the transmission cylinder (22) is in threaded connection with an upper end of the connecting cylinder (27), and a lower end of the connecting cylinder (27) is in threaded connection with the lower joint (26);

a step A (2101) is machined on the inner tooth cylinder (21) for limiting a position of the outer tooth cylinder (20);

a step B (2003) is machined on the outer tooth cylinder (20) for being matched with the step A (2101) for limiting;

a bearing A (23) is assembled between the connecting cylinder (27) and the limiting cylinder (24);

a bearing B (25) is assembled between the connecting cylinder (27) and the body (14);

the piston (18) is assembled in a cavity formed by the plug (15) and the inner tooth cylinder (21), and the piston (18) is fixed on the body (14) through the fixing screw B (17); and the pressure sensor (7) and the electromagnetic valve (8) are in threaded connection onto the body (14).

The tool is composed of 2 to 4 first-stage clutch mechanisms (100) or second-stage clutch mechanisms (200) to meet requirements of different control precisions and drill rod rotating speeds.

4 to 8 battery mounting holes are machined in the battery compartment (6), and 4 to 8 batteries (5) are mounted to meet requirements of different electric energy.

The cover plate (3) is composed of a signal channel (3001) and a cover plate body (3002), and the signal channel (3001) is made of a ceramic material and sintered on the cover plate body (3002) to provide the signal channel for wireless electromagnetic wave transmission.

1 to 3 radial through holes are machined in the inner tooth cylinder (21) for balancing an internal pressure of a cavity formed by the inner tooth cylinder (20) and the body (14); and 1 to 3 radial through holes (29) are machined in the limiting cylinder (24) for lubricating a bearing assembly (13) and balancing an internal pressure of a cavity formed by the limiting cylinder (24) and the body (14).

An inner side and an outer side of the piston (18) are both provided with a combined sealing system of a dust ring (1801)+a sealing ring (1802)+a supporting ring (1803) for isolating pressures of a piston upper hydraulic cavity (16) and a piston lower hydraulic cavity (19).

A diamond compact (28) is sintered at a lower end of the body (14) and an upper end of the lower joint (26) to reduce a friction coefficient between the body (14) and the lower joint (26), thus improving wear resistance of the body (14) and the lower joint (26).

A seam between an upper end of the limiting cylinder (24) and the outer tooth cylinder (20) is welded and fixed to prevent the limiting cylinder (24) from falling, so as to avoid a falling risk of the transmission cylinder (22) and the lower joint (26) caused by loosening of the limiting cylinder (24), thus further avoiding other drill tools from falling.

The electromagnetic valve (8) is a two-position four-way electromagnetic valve, or an electromagnetic valve set capable of realizing the same function.

Rectangular teeth A (2102) are machined in an axial direction and a circumferential direction of the inner tooth cylinder (21), rectangular teeth B (2001) are machined in an axial direction and a circumferential direction of the outer tooth cylinder (20), and the rectangular teeth A (2102) and the rectangular teeth B (2001) have the same number.

Compared with the prior art, the present invention has the following advantages.

(1) High tool face angle control precision: the control of different angles by using a second-stage clutch module can reduce the tool face angle control precision of 20° to 30° of the first-stage clutch module to less than 5°.

(2) High drill rod rotating speed: the present invention has clutch modules of two stages or more stages, a total clutching frequency of the tool is high, and theoretically, when there is one more clutch module, the rotating speed is twice as high. Therefore, a higher rotating speed of the drill rod can be provided.

(3) Low drill tool jamming risk: for example, a minimum outer diameter of the present invention may be 165 mm for a 215.9 mm borehole, while an outer diameter of a conventional rotary guidance tool is 210 mm, so that the drill tool jamming risk of the present invention is significantly reduced compared with conventional rotary guidance.

(4) Low cost: the present invention has a simple structure, and does not involve parts such as a high-temperature and high-pressure motor, a pump and a pressure compensation pup joint, so that the cost is lower.

Figure 1:
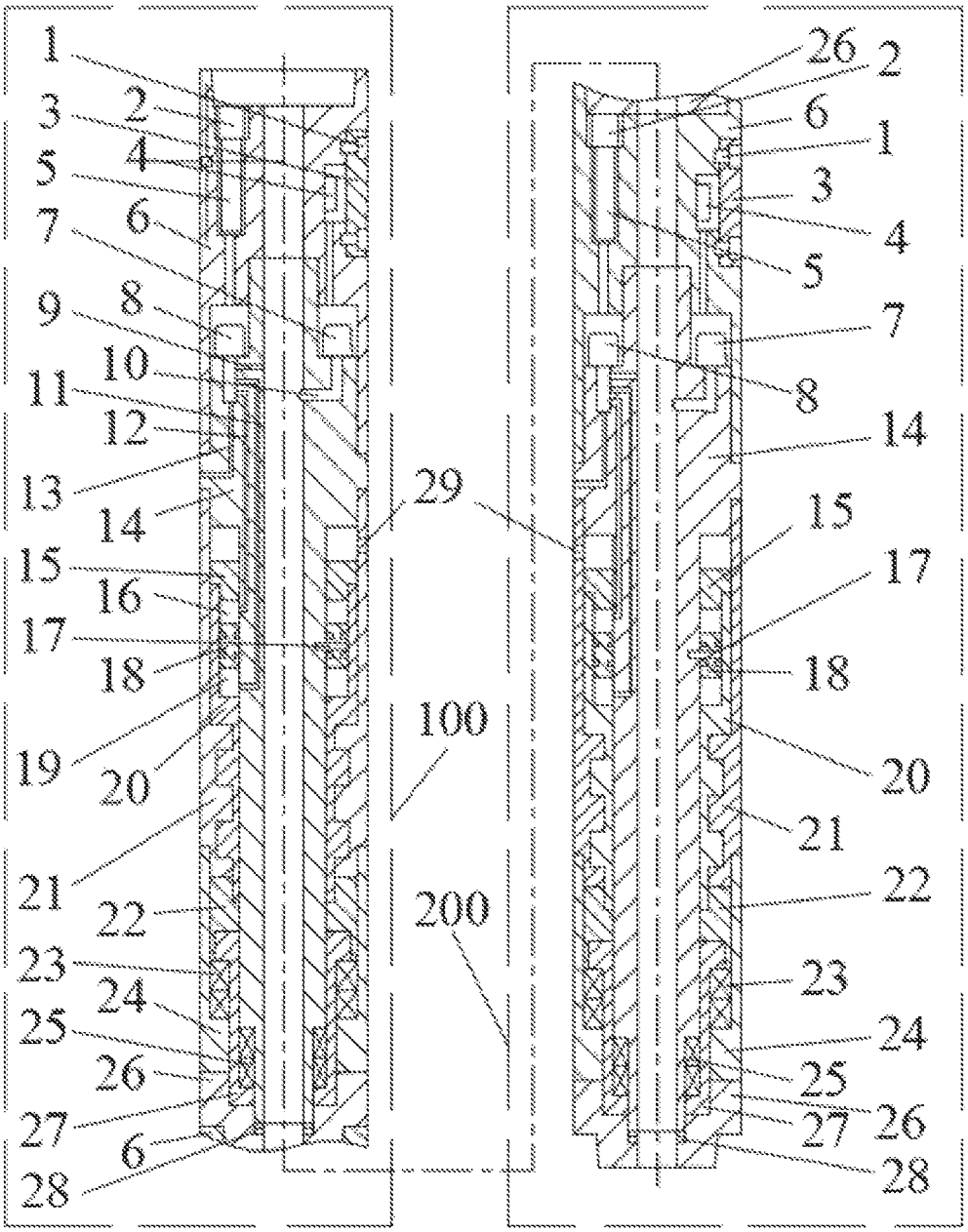
FIG. 1 is an assembly diagram of a two-stage reverse-torque bent screw orientation tool.

In the drawings: 1 refers to fixing screw A, 2 refers to battery plug, 3 refers to cover plate, 3001 refers to signal channel, 3002 refers to cover plate body, 4 refers to circuit board, 5 refers to battery, 6 refers to battery compartment, 7 refers to pressure sensor, 8 refers to electromagnetic valve, 9 refers to electromagnetic valve P-port hydraulic channel, 10 refers to pressure sensor hydraulic channel, 11 refers to electromagnetic valve A-port hydraulic channel, 12 refers to electromagnetic valve B-port hydraulic channel, 13 refers to electromagnetic valve T-port hydraulic channel, 14 refers to body, 15 refers to plug, 16 refers to piston upper hydraulic cavity, 17 refers to fixing screw B, 18 refers to piston, 1801 refers to dust ring, 1802 refers to sealing ring, 1803 refers to supporting ring, 19 refers to piston lower hydraulic cavity, 20 refers to outer tooth cylinder, 2001 refers to rectangular tooth B, 2002 refers to spline A, 2003 refers to step B, 21 refers to inner tooth cylinder, 2101 refers to step A, 2102 refers to rectangular tooth A, 22 refers to transmission cylinder, 2201 refers to spline B, 23 refers to bearing A, 24 refers to limiting cylinder, 25 refers to bearing B, 26 refers to lower joint, 27 refers to connecting cylinder, 28 refers to diamond compact, 29 refers to radial through hole, 30 refers to drill rod, 31 refers to bent screw, 32 refers to drill bit, 100 refers to first-stage clutch mechanism, and 200 refers to second-stage clutch mechanism.

DETAILED DESCRIPTION OF PREFERRED EMBODIMENTS

In order to understand the technical features, objects and effects of the present invention more clearly, specific embodiments of the present invention are now described with reference to the drawings.

Figure 2:
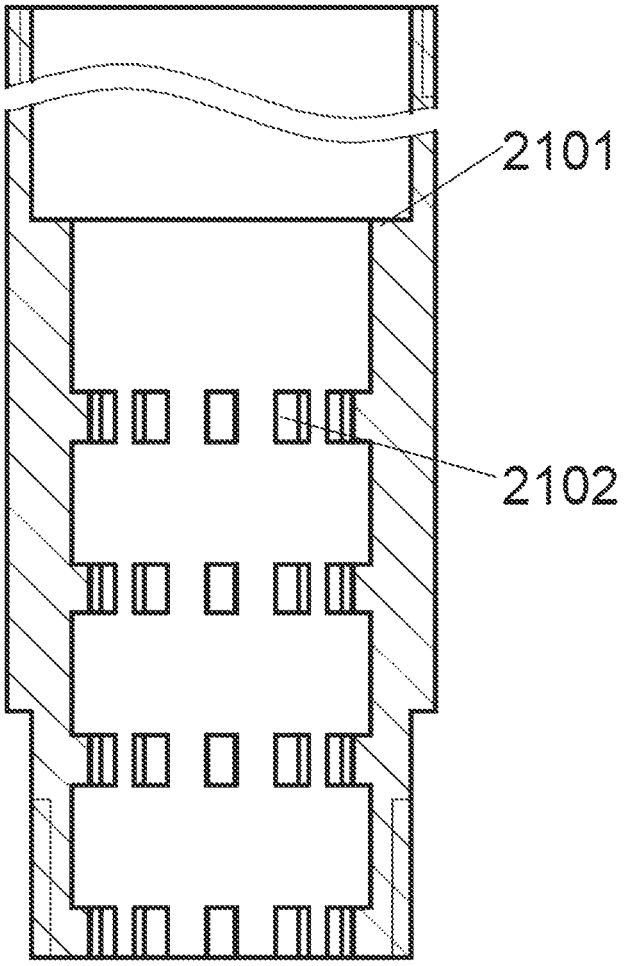
FIG. 2 is a full section view of an inner tooth cylinder.
Figure 3:
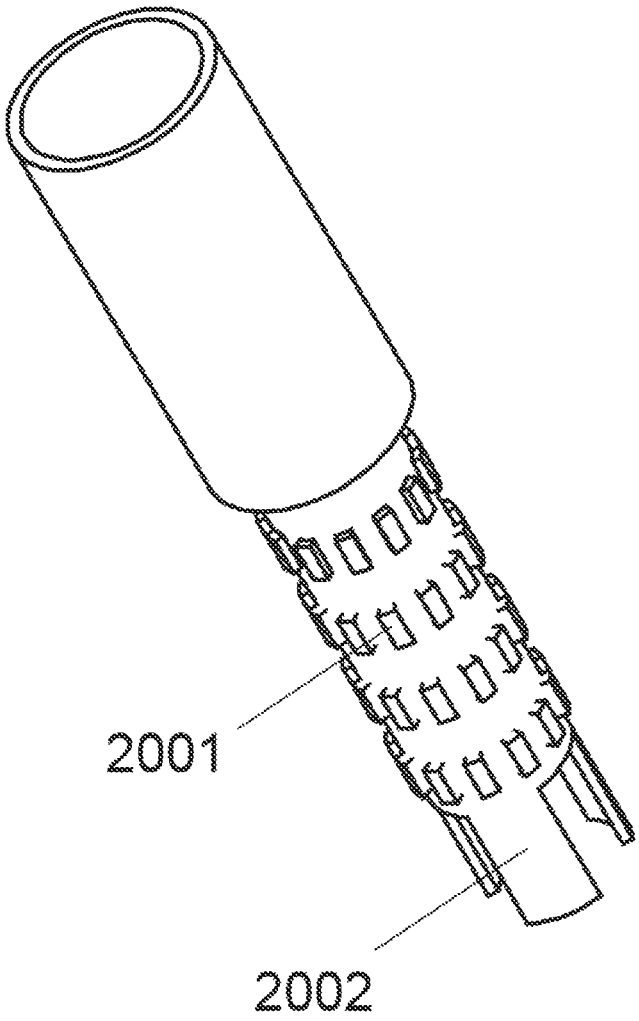
FIG. 3 is a schematic structural diagram of an outer tooth cylinder.
Figure 4:
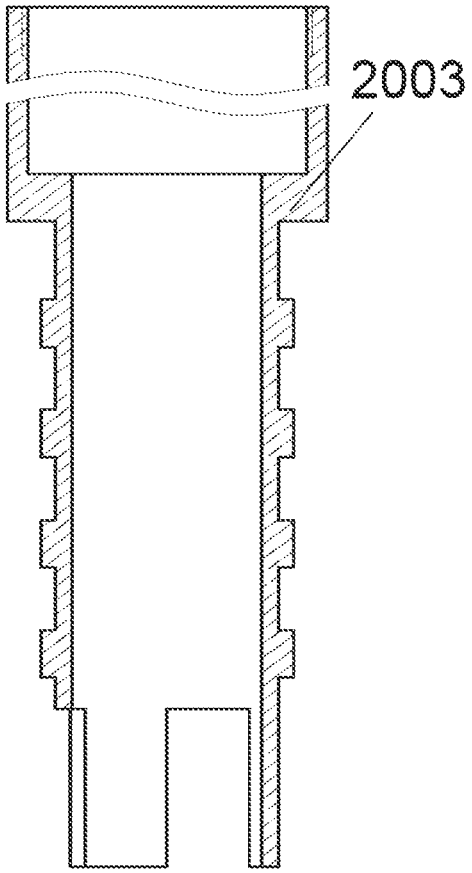
FIG. 4 is a full section view of the outer tooth cylinder.
Figure 5:
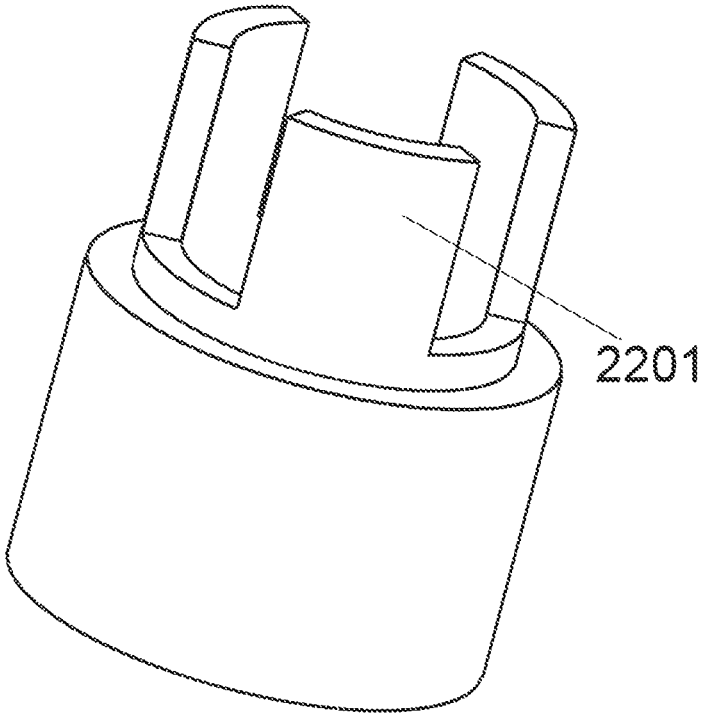
FIG. 5 is a schematic structural diagram of a transmission cylinder.
Figure 6:
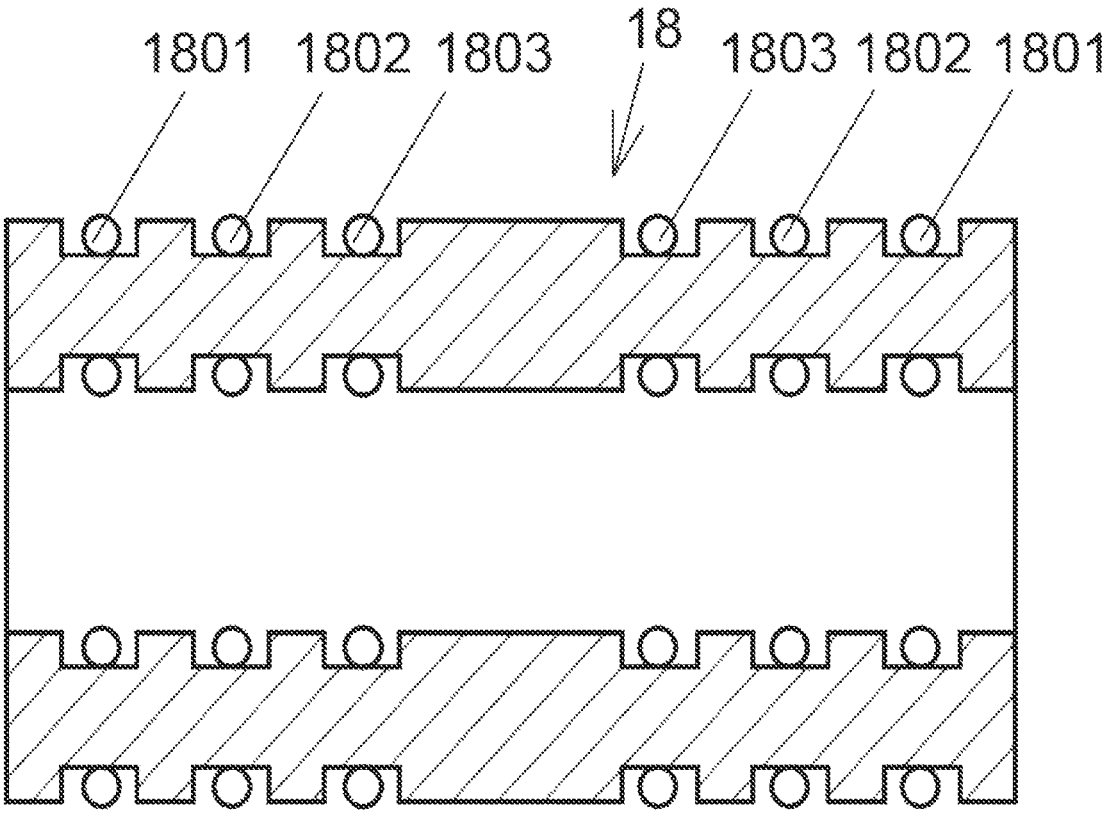
FIG. 6 is a full section view of a piston.
Figure 7:
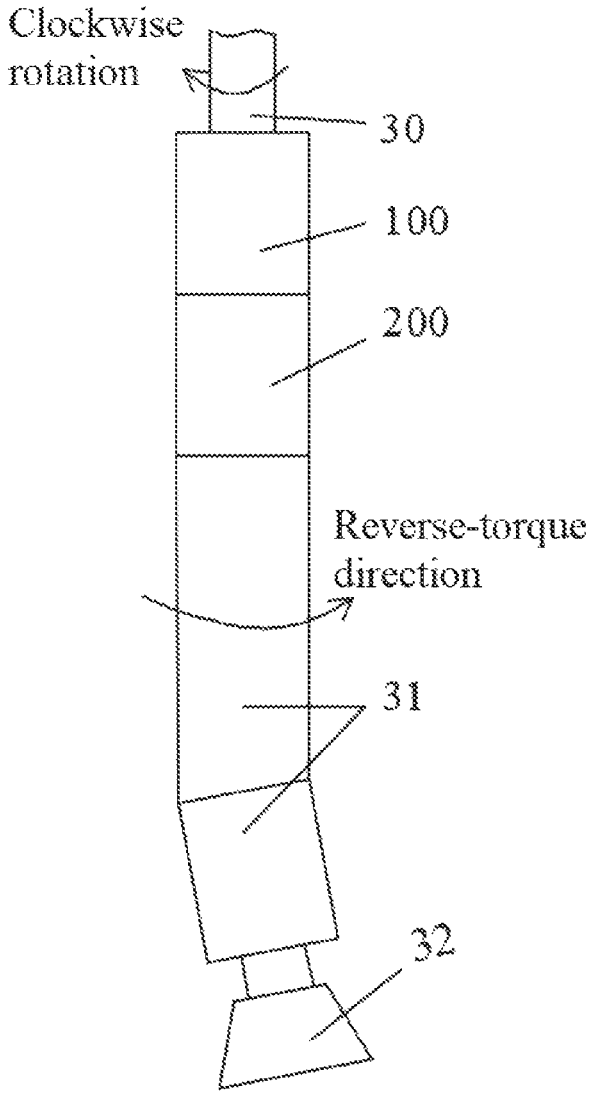
FIG. 7 is a schematic diagram of the two-stage reverse-torque bent screw orientation tool.

As shown in FIG. 1 to FIG. 3, the embodiment provides a two-stage reverse-torque bent screw orientation tool, which is composed of a first-stage clutch mechanism (100) and a second-stage clutch mechanism (200), wherein the first-stage clutch mechanism (100) and the second-stage clutch mechanism (200) are both composed of a fixing screw A (1), a battery plug (2), a cover plate (3), a circuit board (4), a battery (5), a battery compartment (6), a pressure sensor (7), an electromagnetic valve (8), a body (14), a plug (15), a fixing screw B (17), a piston (18), an outer tooth cylinder (20), an inner tooth cylinder (21), a transmission cylinder (22), a bearing A (23), a limiting cylinder (24), a bearing B (25), a lower joint (26), a connecting cylinder (27) and a diamond compact (28).

The lower joint (26) of the first-stage clutch mechanism (100) is in threaded connection with the battery compartment (6) of the second-stage clutch mechanism (200).

The battery compartment (6) is in threaded connection with the body (14), the body (14) is in threaded connection with an upper end of the inner tooth cylinder (21), and a lower end of the inner tooth cylinder (21) is in threaded connection with the limiting cylinder (24).

The plug (15) is in threaded connection with an upper end of the outer tooth cylinder (20), a spline A (2002) at a lower end of the outer tooth cylinder (20) is in splined connection with a spline B (2201) at an upper end of the transmission cylinder (22), a lower end of the transmission cylinder (22) is in threaded connection with an upper end of the connecting cylinder (27), and a lower end of the connecting cylinder (27) is in threaded connection with the lower joint (26).

A step A (2101) is machined on the inner tooth cylinder (21) for limiting a position of the outer tooth cylinder (20).

A step B (2003) is machined on the outer tooth cylinder (20) for being matched with the step A (2101) for limiting.

A bearing A (23) is assembled between the connecting cylinder (27) and the limiting cylinder (24).

A bearing B (25) is assembled between the connecting cylinder (27) and the body (14).

The piston (18) is assembled in a cavity formed by the plug (15) and the inner tooth cylinder (21), and the piston (18) is fixed on the body (14) through the fixing screw B (17).

The pressure sensor (7) and the electromagnetic valve (8) are in threaded connection onto the body (14).

Specifically, the two-stage reverse-torque bent screw orientation tool is assembled and debugged on the ground, and then lowered into a bottom hole, and if orientation operation is needed, a ground mud pulse emits a mud pulse signal of a target tool face angle A. The pressure sensor (7) of the second-stage clutch mechanism (200) receives a mud pressure pulse of the target tool face angle A. The circuit board (4) of the second-stage clutch mechanism (200) measures a current tool face angle B in real time, and calculates a rotating speed of the drill rod (30) according to a change law of the above tool face angle B, and the circuit board (4) of the second-stage clutch mechanism (200) distributes clutching frequencies N1 and N2 to the first-stage clutch mechanism (100) and the second-stage clutch mechanism (200) according to the rotating speed. The circuit board (4) of the second-stage clutch mechanism (200) transmits a wireless electromagnetic wave signal with the clutching frequency N1 to the first-stage clutch mechanism (100), and the circuit board (4) of the first-stage clutch mechanism (100) receives the signal with the clutching frequency N1. The circuit board (4) in the first-stage clutch mechanism (100) controls the electromagnetic valve (8) in the first-stage clutch mechanism (100) to be turned on and off according to the N1, thus controlling the first-stage clutch mechanism (100) to be clutched. Meanwhile, the circuit board (4) of the second-stage clutch mechanism (200) controls an on-off frequency of the electromagnetic valve (8) of the second-stage clutch mechanism (200). The circuit board (4) of the second-stage clutch mechanism (200) adjusts the on-off frequency of the electromagnetic valve (8) of the second-stage clutch mechanism (200) in real time by comparing with the target tool face angle A and measuring an error of the current tool face angle B in real time, so that the target tool face angle A meets a drilling requirement.

Specifically, because the piston (18) is fixed on the body (14) by the fixing screw B (17), when the piston upper hydraulic cavity (16) is high in pressure and the piston lower hydraulic cavity (19) is low in pressure, the outer tooth cylinder (20) moves down; and when the piston upper hydraulic cavity (16) is low in pressure and the piston lower hydraulic cavity (19) is high in pressure, the outer tooth cylinder (20) moves up. During orientation, the electromagnetic valve (8) controls high-pressure mud in the two-stage reverse-torque bent screw orientation tool and low-pressure mud in an annulus to alternately enter the piston upper hydraulic cavity (16) and the piston lower hydraulic cavity (19), and under an alternating action of high and low pressures, the outer tooth cylinder (20) moves up and down. Meanwhile, a counter-clockwise reverse torque generated by rock breaking by the drill bit (32) is transmitted to the lower joint (26) through a bent screw, the lower joint (26) transmits the counter-clockwise torque to the connecting cylinder (27), the connecting cylinder (27) transmits the counter-clockwise torque to the transmission cylinder (22), and the transmission cylinder (22) transmits the counter-clockwise torque to the outer tooth cylinder (20). Under a joint action of the counter-clockwise torque and the up-and-down movement, the outer tooth cylinder (20) is repeatedly engaged with and disengaged from the outer tooth cylinder (21), and the outer tooth cylinder (20) rotates counterclockwise by a certain angle when being engaged and disengaged once, thus offsetting a clockwise rotation angle of the drill rod (30), so as to realize dynamic control of the tool face angle.

Specifically, if oriented drilling is not needed, the ground mud pulse emits a mud pulse signal of "stopping orientation", and the pressure sensor (7) of the second-stage clutch mechanism (200) receives the mud pressure pulse signal of "stopping orientation". The circuit board (4) of the second-stage clutch mechanism (200) transmits a wireless electromagnetic wave signal of "stopping orientation" to the first-stage clutch mechanism (100), and the circuit board (4) of the first-stage clutch mechanism (100) receives the wireless electromagnetic wave signal of "stopping orientation". The circuit board (4) of the first-stage clutch mechanism (100) controls the electromagnetic valve (8) to be turned off, thus stopping orientation. Meanwhile, the circuit board (4) of the second-stage clutch mechanism (200) controls the electromagnetic valve (8) of the second-stage clutch mechanism (200) to be turned off, thus stopping orientation.

The above are merely specific embodiments of the present invention for illustrative purpose, and are not intended to limit the scope of the present invention. Equivalent changes and modifications made by any person skilled in the art without departing from the concept and principle of the present invention should all belong to the scope of protection of the present invention.

We claim:

1. A two-stage reverse-torque bent screw orientation tool, composed of a first-stage clutch mechanism (100) and a second-stage clutch mechanism (200), wherein the first-stage clutch mechanism (100) and the second-stage clutch mechanism (200) are both composed of a fixing screw A (1), a battery plug (2), a cover plate (3), a circuit board (4), a battery (5), a battery compartment (6), a pressure sensor (7), an electromagnetic valve (8), a body (14), a plug (15), a fixing screw B (17), a piston (18), an outer tooth cylinder (20), an inner tooth cylinder (21), a transmission cylinder (22), a bearing A (23), a limiting cylinder (24), a bearing B (25), a lower joint (26), a connecting cylinder (27) and a diamond compact (28);

the lower joint (26) of the first-stage clutch mechanism (100) is in threaded connection with the battery compartment (6) of the second-stage clutch mechanism (200);

the battery compartment (6) is in threaded connection with the body (14), the body (14) is in threaded connection with an upper end of the inner tooth cylinder (21), and a lower end of the inner tooth cylinder (21) is in threaded connection with the limiting cylinder (24);

the plug (15) is in threaded connection with an upper end of the outer tooth cylinder (20), a spline A (2002) at a lower end of the outer tooth cylinder (20) is in splined connection with a spline B (2201) at an upper end of the transmission cylinder (22), a lower end of the transmission cylinder (22) is in threaded connection with an upper end of the connecting cylinder (27), and a lower end of the connecting cylinder (27) is in threaded connection with the lower joint (26);

a step A (2101) is machined on the inner tooth cylinder (21) for limiting a position of the outer tooth cylinder (20);

a step B (2003) is machined on the outer tooth cylinder (20) for being matched with the step A (2101) for limiting;

a bearing A (23) is assembled between the connecting cylinder (27) and the limiting cylinder (24);

a bearing B (25) is assembled between the connecting cylinder (27) and the body (14);

the piston (18) is assembled in a cavity formed by the plug (15) and the inner tooth cylinder (21), and the piston (18) is fixed on the body (14) through the fixing screw B (17); and the pressure sensor (7) and the electromagnetic valve (8) are in threaded connection onto the body (14).

2. The two-stage reverse-torque bent screw orientation tool according to claim 1, wherein the tool is composed of 2 to 4 first-stage clutch mechanisms (100) or second-stage clutch mechanisms (200) to meet requirements of different control precisions and drill rod rotating speeds.

3. The two-stage reverse-torque bent screw orientation tool according to claim 1, wherein 4 to 8 battery mounting holes are machined in the battery compartment (6), and 4 to 8 batteries (5) are mounted to meet requirements of different electric energy.

4. The two-stage reverse-torque bent screw orientation tool according to claim 1, wherein the cover plate (3) is composed of a signal channel (3001) and a cover plate body (3002), and the signal channel (3001) is made of a ceramic material and sintered on the cover plate body (3002) to provide the signal channel for wireless electromagnetic wave transmission.

5. The two-stage reverse-torque bent screw orientation tool according to claim 1, wherein 1 to 3 radial through holes are machined in the inner tooth cylinder (21) for balancing an internal pressure of a cavity formed by the inner tooth cylinder (20) and the body (14); and 1 to 3 radial through holes (29) are machined in the limiting cylinder (24) for lubricating a bearing assembly (13) and balancing an internal pressure of a cavity formed by the limiting cylinder (24) and the body (14).

6. The two-stage reverse-torque bent screw orientation tool according to claim 1, wherein an inner side and an outer side of the piston (18) are both provided with a combined sealing system of a dust ring (1801), a sealing ring (1802), and a supporting ring (1803) for isolating pressures of a piston upper hydraulic cavity (16) and a piston lower hydraulic cavity (19).

7. The two-stage reverse-torque bent screw orientation tool according to claim 1, wherein a diamond compact (28) is sintered at a lower end of the body (14) and an upper end of the lower joint (26) to reduce a friction coefficient between the body (14) and the lower joint (26), thus improving wear resistance of the body (14) and the lower joint (26).

8. The two-stage reverse-torque bent screw orientation tool according to claim 1, wherein a seam between an upper end of the limiting cylinder (24) and the outer tooth cylinder (20) is welded and fixed to prevent the limiting cylinder (24) from falling, so as to avoid a falling risk of the transmission cylinder (22) and the lower joint (26) caused by loosening of the limiting cylinder (24), thus further avoiding other drill tools from falling.

9. The two-stage reverse-torque bent screw orientation tool according to claim 1, wherein the electromagnetic valve (8) is a two-position four-way electromagnetic valve, or an electromagnetic valve set capable of realizing the same function.

10. The two-stage reverse-torque bent screw orientation tool according to claim 1, wherein rectangular teeth A (2102) are machined in an axial direction and a circumferential direction of the inner tooth cylinder (21), rectangular teeth B (2001) are machined in an axial direction and a circumferential direction of the outer tooth cylinder (20), and the rectangular teeth A (2102) and the rectangular teeth B (2001) have the same number.

* * * * *